US007421991B2

(12) United States Patent
Lequesne et al.

(10) Patent No.: US 7,421,991 B2
(45) Date of Patent: Sep. 9, 2008

(54) BRAKE-ACTUATED VANE-TYPE CAMSHAFT PHASER

(75) Inventors: Bruno Lequesne, Troy, MI (US); Elias Taye, Macomb Township, MI (US)

(73) Assignee: Delphi Technologies, Inc., Troy, MI (US)

( * ) Notice: Subject to any disclaimer, the term of this patent is extended or adjusted under 35 U.S.C. 154(b) by 205 days.

(21) Appl. No.: 11/507,761

(22) Filed: Aug. 22, 2006

(65) Prior Publication Data

US 2008/0047512 A1 Feb. 28, 2008

(51) Int. Cl.
*F01L 1/34* (2006.01)

(52) U.S. Cl. ..... 123/90.17; 123/90.15; 123/90.16; 92/69 R; 92/122

(58) Field of Classification Search ..... 123/90.17
See application file for complete search history.

(56) References Cited

U.S. PATENT DOCUMENTS 4,770,060 A 9/1988 Elrod et al.
4,771,742 A 9/1988 Nelson et al.
4,967,701 A * 11/1990 Isogai et al. ..... 123/90.11
5,058,536 A 10/1991 Johnston
5,117,784 A * 6/1992 Schechter et al. ..... 123/90.17
5,136,887 A 8/1992 Elrod et al.
5,161,429 A 11/1992 Elrod et al.
5,253,546 A 10/1993 Elrod et al.
5,417,186 A 5/1995 Elrod et al.
6,257,186 B1 7/2001 Heer
6,302,073 B1 10/2001 Heer
6,328,006 B1 12/2001 Heer
6,915,767 B2 7/2005 Pfeiffer et al.
7,150,251 B2 * 12/2006 Watanabe et al. ..... 123/90.17

FOREIGN PATENT DOCUMENTS

AT 410 825 B 8/2003

* cited by examiner

*Primary Examiner*—Thomas Denion
*Assistant Examiner*—Kyle M Riddle
(74) *Attorney, Agent, or Firm*—MIchael D. Smith

(57) ABSTRACT

A vane-type camshaft phaser includes a vaned camshaft rotor disposed within a lobed stator, defining phase advance and retard chambers filled with oil. The height of the rotor is less than the height of the stator, providing space for a vaned brake rotor alongside the camshaft rotor. The brake rotor is free to rotate independently of the camshaft rotor. The volume of each advance and retard chamber is a function of the rotational position of both the camshaft rotor and the brake rotor, and the volume of each chamber is constant. Rotation of the brake rotor in one direction causes rotation of the camshaft rotor in the opposite direction. The brake rotor is connected to a controllable brake mechanism. By sensing of the camshaft rotor position and feedback control of the braking mechanism, the camshaft rotor may be maintained at any position.

7 Claims, 4 Drawing Sheets

BRAKE-ACTUATED VANE-TYPE CAMSHAFT PHASER

TECHNICAL FIELD

The present invention relates to camshaft phasers for varying the timing of combustion valves in internal combustion engines; more particularly, to mechanism for varying the phaser relationship between an engine crankshaft and engine camshaft within a camshaft phaser; and most particularly, to a camshaft phaser actuated by a variable braking mechanism.

BACKGROUND OF THE INVENTION

Vane-type camshaft phasers for varying the timing of combustion valves in an internal combustion engines are well known. In a vane-type phaser, timing advance and retard chambers are formed within the phaser between inwardly-extending lobes of a generally cylindrical stator and outwardly-extending vanes of a rotor concentrically disposed within the stator. The stator is mechanically coupled and indexed to the rotational position of the engine crankshaft, and the rotor is mechanically coupled to the camshaft.

Typically, a camshaft phaser includes an oil control valve for controlling oil flow into and out of the advance and retard chambers to rotate the rotor with respect to the stator. The valve receives pressurized oil from an oil gallery in the engine block and selectively distributes oil to controllably vary the phase relationship between the engine's camshaft and crankshaft. By using pulse width modulated (PWM) control of the oil valve, cam timing is altered by command from an engine control module (ECM). In this manner, the oil control valve is a throttle and direction control valve that modulate cam position and the speed with which it changes from one position to another.

Several problems are known to exist with prior art oil-pressure actuated vane-type phasers.

First, engine oil pressure typically is relatively low at low engine speeds, and therefore at low engine speeds the response of a prior art camshaft phaser can be sluggish and not predictable.

Second, oil viscosity is temperature dependent, and therefore phaser operation at low ambient temperatures and high oil viscosity can be slow and unreliable. At high engine temperatures, as may occur in warm climates, engine viscosity can be undesirably low, resulting as above in low oil pressure.

Third, for fast phaser actuation a larger engine oil pump may be required, at a cost of additional parasitic energy drain on the engine and increased engine manufacturing cost.

What is needed in the art is a camshaft phaser system that does not rely on dynamic supply of engine oil under pressure for actuation of a camshaft rotor.

It is a principal object of the present invention to provide camshaft phasing that is independent of a dynamic supply of engine oil to the phaser.

It is a further object of the invention to provide reliable camshaft phasing over a wide range of engine speeds and operating temperatures.

SUMMARY OF THE INVENTION

Briefly described, a vane-type camshaft phasing system includes a camshaft rotor disposed conventionally within a chamber formed in a lobed stator, defining phase advance and retard chambers therebetween filled with oil. The rotor and stator each have a plurality of respective vanes and lobes. The height of the rotor is less than the height of the stator, providing space for a vaned brake rotor alongside the vaned camshaft rotor within the stator chamber, the brake rotor being free to rotate independently of the camshaft rotor. Thus, the volume of each advance and retard chamber at any given time is a function of the rotational position of both the camshaft rotor and the brake rotor. Further, the volume of each advance and retard chamber is constant, so that rotation of the brake rotor in one direction causes rotation of the camshaft rotor in the opposite direction. Manipulation of the brake rotor is used to vary the phase of the camshaft with respect to the stator, which is operationally connected to the engine crankshaft. The brake rotor is connected to a brake mechanism, such as a hysteresis brake, eddy current brake, friction brake, or the like.

In operation, when the brake mechanism is de-energized, frictional torque of the camshaft and valves will automatically urge the camshaft rotor in the retard direction, thus driving the brake rotor in the advance direction. As the brake is progressively actuated, the retarding force on the camshaft rotor is progressively countered. When brake friction exceeds camshaft friction, the camshaft rotor begins to move in the phase-advance direction. By appropriate sensing of the camshaft rotor position and corresponding feedback control of the braking mechanism, the camshaft rotor may be stopped and maintained at any desired position in its range of authority.

BRIEF DESCRIPTION OF THE DRAWINGS

The present invention will now be described, by way of example, with reference to the accompanying drawings, in which.

The exemplifications set out herein illustrate currently preferred embodiments of the invention, and such exemplifications are not to be construed as limiting the scope of the invention in any manner.

DESCRIPTION OF THE PREFERRED EMBODIMENTS

The benefits and advantages of a camshaft phaser system in accordance with the invention may be better appreciated by first considering a prior art phaser having pressurized oil actuation from an engine oil supply.

Figure 1:
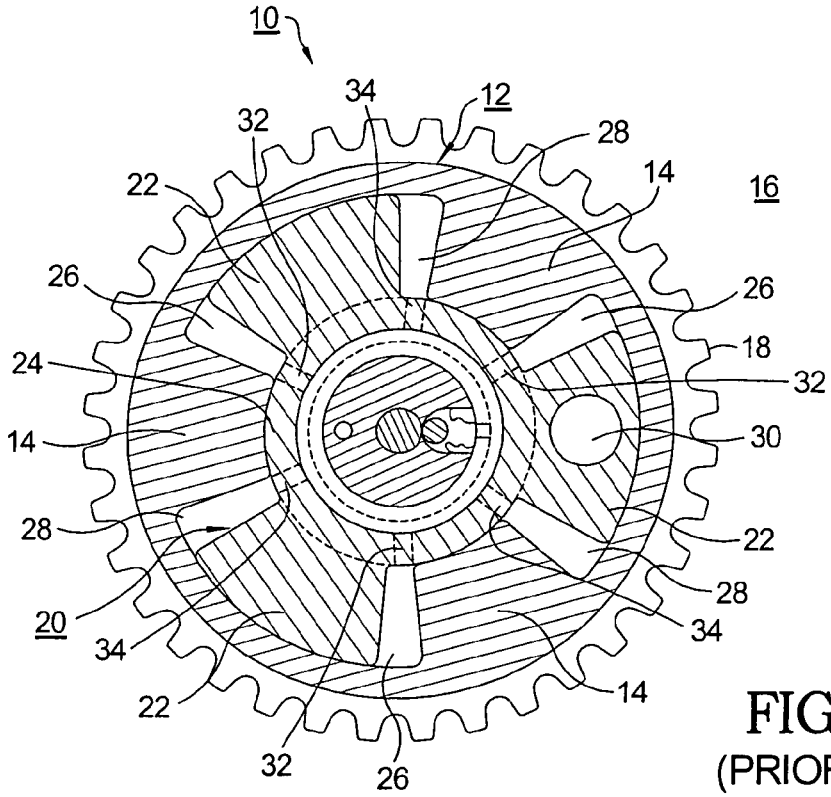
FIG. 1. (PRIOR ART)
FIG. 1 is a cross-sectional view of a prior art camshaft phaser, showing a three-vaned rotor operative within a three-lobed stator.

Referring to FIG. 1, in a prior art camshaft phaser 10, a conventional stator 12 has a generally cylindrical shape and a plurality of angularly spaced-apart radial lobes 14 extending inwardly. Stator 12 is adapted to be driven rotationally by the crankshaft assembly (not shown) of an internal combustion engine 16 via a conventional sprocket wheel 18. Concentrically disposed within stator 12 is a rotor 20 having a plurality of conventional radial vanes 22 extending outwardly from a central hub 24, vanes 22 being interspersed with lobes 14 such that conventional first and second chambers 26,28 are formed on either side of each vane 22 for respectively advancing or retarding the position of the rotor with respect to the stator. Chambers 26,28 are closed axially by sprocket wheel 18 and a cover plate (not visible in FIG. 1). All first and second chambers 26,28 are filled with oil. Prior art phaser assembly 10 may optionally include a locking pin subassembly 30 disposed in a vane 22 for rotationally immobilizing the rotor with respect to the stator at a specific predetermined relative angle, for example, full retard of the valve timing. Pressurized actuating oil is provided to first chambers 26 via first passages 32 in hub 24, and to second chambers 28 via second passages 34 in hub 24.

Figure 2:
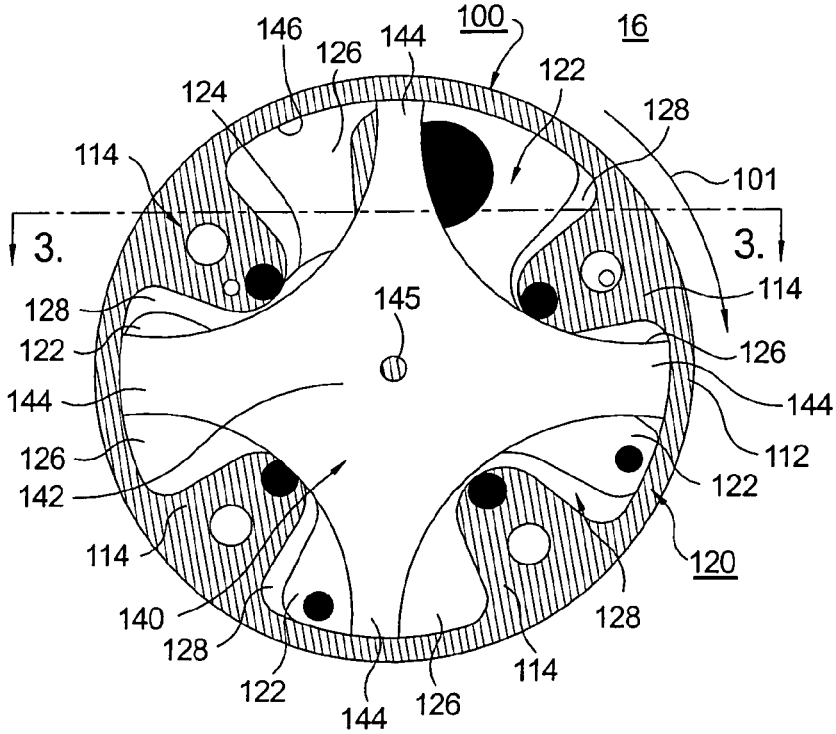
FIG. 2 is a cross-sectional view of a first embodiment of a camshaft phaser improved in accordance with the present invention, showing a four-vaned camshaft rotor and a four-vaned brake rotor operative within a four-lobed stator.

Referring to FIG. 2, a first embodiment 100 of a camshaft phaser improved in accordance with the present invention comprises a stator 112 similar to prior art stator 12 and having a generally cylindrical shape and a plurality of angularly spaced-apart radial lobes 114 (in the present example, four lobes) extending inwardly. Stator 112 is adapted to be driven rotationally by the crankshaft assembly (not shown) of an internal combustion engine 16 via a conventional sprocket wheel (not shown) similar to prior art sprocket wheel 18. Concentrically disposed within stator 112 is a camshaft rotor 120 similar to prior art rotor 20 and having a plurality of conventional radial vanes 122 extending outwardly from a central hub 124, vanes 122 being interspersed with lobes 114 such that first and second chambers 126,128 are formed on either side of each vane 122 for respectively advancing or retarding the position of the rotor with respect to the stator. (For discussion purposes herein, phaser 100 is being driven clockwise 101, thereby defining chambers 126 as phase advance chambers and chambers 128 as phase retard chambers. Chambers 126,128 are closed axially by the sprocket wheel and a cover plate (also not visible in FIG. 2). All first and second chambers 126,128 are filled with oil. Camshaft rotor 120 in operation is attached to a camshaft 152 (see FIG. 7) of engine 16 and rotates therewith in known fashion.

Figure 7:
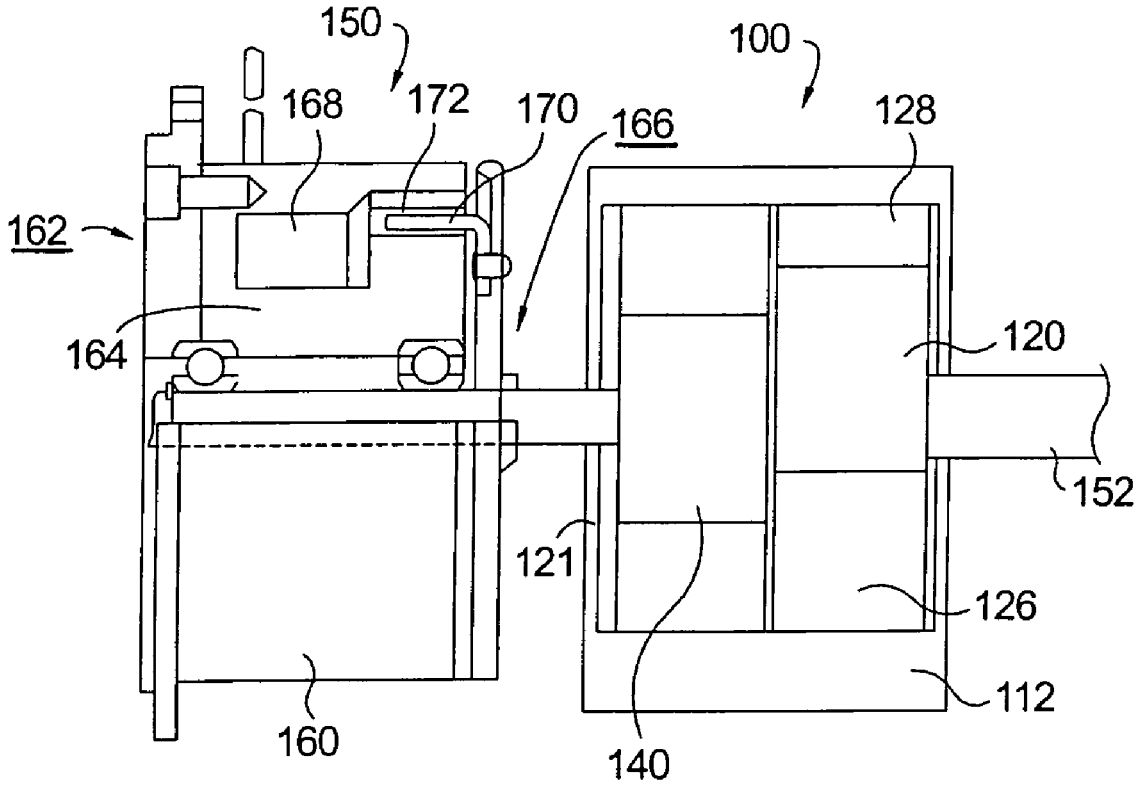
FIG. 7 is a schematic cross-sectional view of a camshaft phaser in accordance with the invention, showing an exemplary braking apparatus for rotary positioning of the brake rotor.

The axial height, or thickness, of camshaft rotor 120 is less than the axial height, or thickness of stator 112, defining a thickness difference therebetween. A brake rotor 140, comprising a general hub region 142 and a plurality of radially extending vanes 144, has a thickness substantially equal to the rotor/stator thickness difference. Brake rotor 140 is disposed, like camshaft rotor 120, within stator 112 between camshaft rotor 120 and the phaser cover plate 121 (FIG. 7). Camshaft rotor 120 and brake rotor 140 are free to rotate independently of one another about phaser axis 145.

Camshaft rotor vanes 122 and brake rotor vanes 144 are slidingly sealed radially against the cylindrical inner wall 146 of stator 112 and are substantially sealed against leakage between chambers 126 and 128. Thus, it will be seen that the volume of each chamber 126 and each chamber 128 is unique and defined by the size and shape of the stator lobes 114 and the rotor vanes 122,144. It will be further seen that rotation of either of rotors 120,140 in a first direction must cause the other of rotors 120,140 to rotate in the opposite direction due to displacement of oil within the constant-volume chambers 126,128. Thus, when brake means are provided for controlling the rotational position of brake rotor 140, the rotational position of camshaft rotor 120 will be similarly controlled (and thus the camshaft phase angle).

Figure 3:
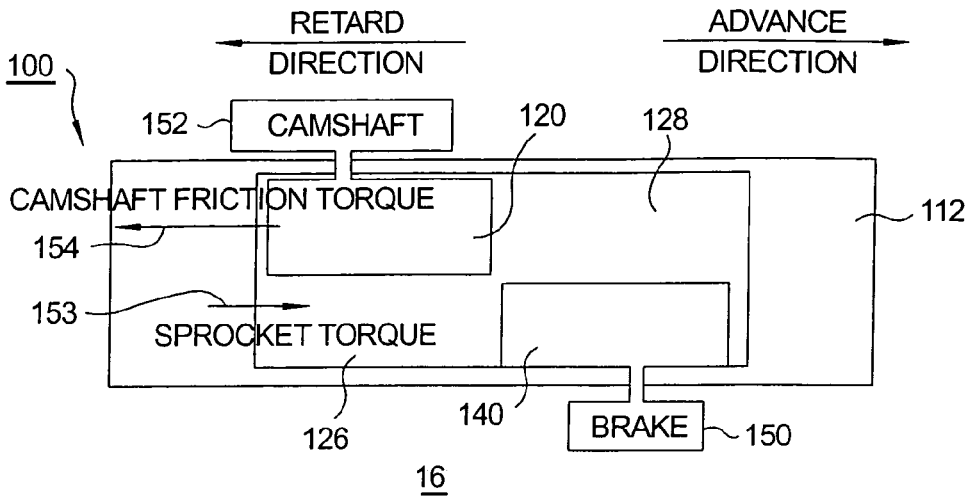
FIG. 3 is a schematic cross-sectional view of the camshaft phaser shown in FIG. 2, taken along line 3-3, and showing the phaser in full camshaft phase retard mode.
Figure 4:
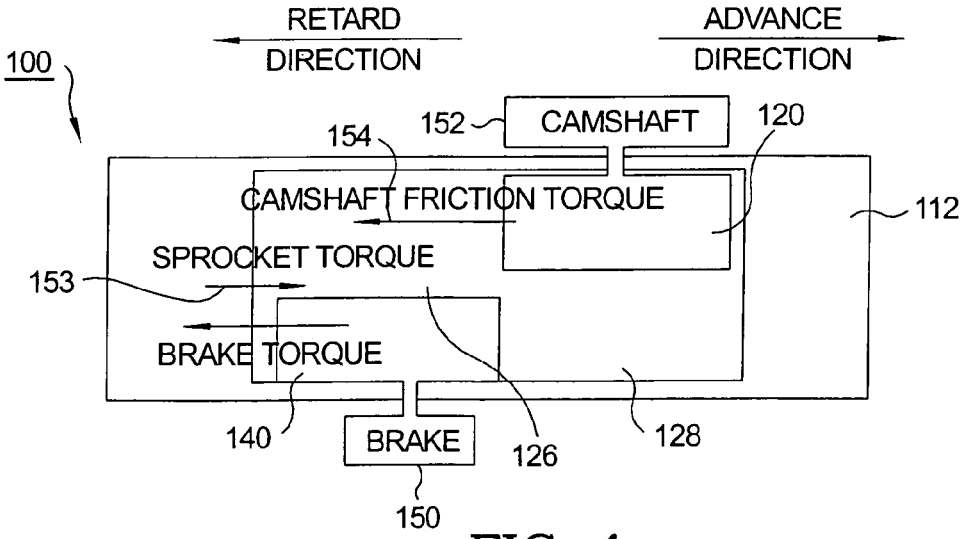
FIG. 4 is a schematic cross-sectional view like that shown in FIG. 3, showing the phaser in full camshaft phase advance mode.
Figure 5:
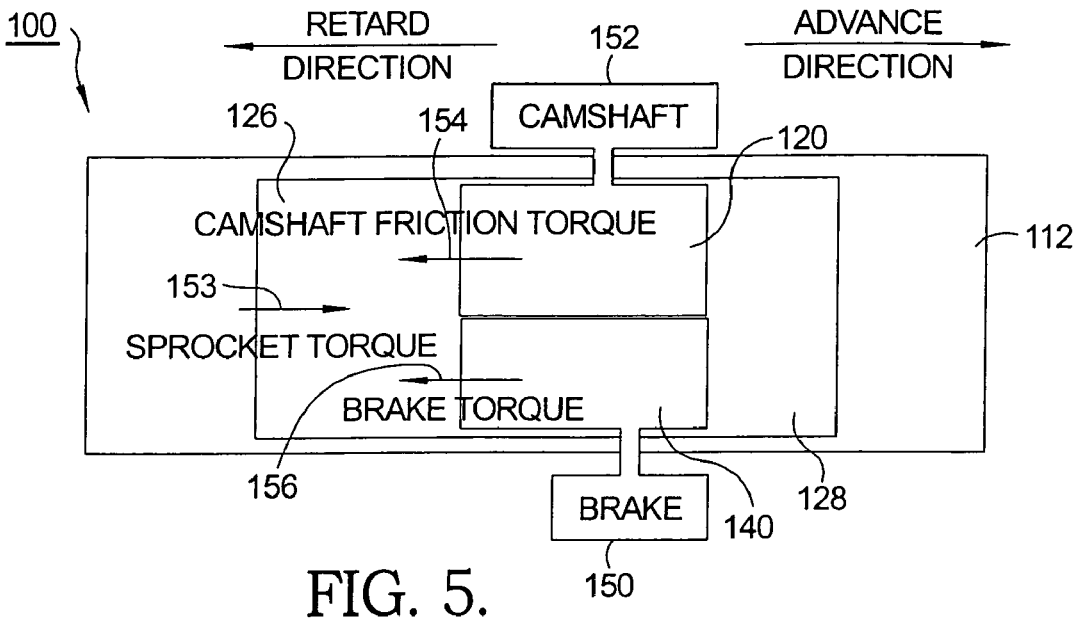
FIG. 5 is a schematic cross-sectional view like that shown in FIG. 3, showing the phaser in a camshaft phase position intermediary between full retard and full advance modes.

This dynamic relationship is shown schematically in FIGS. 3 through 5.

Referring to FIG. 3, respective vanes of camshaft rotor 120 and brake rotor 140 are shown disposed within stator 112, defining phaser advance chamber 126 and phaser retard chamber 128. Brake 150, which exerts a rotation-restraining torque on brake rotor 140 when energized, is de-energized, as for example at engine start-up. The frictional resistance to rotation experienced by the camshaft 152 within the engine is expressed as a camshaft friction torque 154 that drives the camshaft rotor 120 to a fully retarded position. Oil in advance chamber 126 is displaced by camshaft rotor 120 into the brake rotor portion of chamber 126, and simultaneously oil in retard chamber 128 is displaced by brake rotor 140 into the camshaft rotor portion of chamber 128, causing brake rotor 140 to be rotated to a fully advanced position, in the absence of resistance from brake 150.

Referring to FIG. 4, it must be remembered that both camshaft rotor 120 and brake rotor 140 are rotating, with stator 112, under the action of engine sprocket torque 153, all in the same direction 101 about mutual axis 145 (FIG. 2) with respect to engine 16. Brake 150 is grounded to non-rotating engine 16 and is able to exert a rotation-restraining brake torque 156 on brake rotor 140. When brake torque 156 exceeds camshaft friction torque 154, brake rotor 140 is moved in the retard direction within chamber 126 and camshaft rotor 120 is moved in the advance direction within chamber 128. Thus it is possible to control the relative advance and retard positions of camshaft rotor 120 simply by controlling drag on rotation of brake rotor 140.

Referring to FIG. 5, when brake torque 156 equals camshaft friction torque 154, the angular position of camshaft rotor 120, and thus the phase angle of camshaft 152, is set at whatever position is desired between full retard and full advance. The set position of camshaft rotor 120 will remain fixed until brake torque 156 is increased or decreased, as desired to advance or retard, respectively, the phase of camshaft 152 with respect to stator 112.

Note that the operation of improved camshaft phaser 100 is independent of the oil supply system for engine 16, although some replenishment connection thereto is desirable to compensate for leakage and thereby maintain voidless oil fill in chambers 126,128. A check valve (not shown) may be desirable to maintain oil pressure within the phaser at a predetermined value.

Note further that improvements in accordance with the present invention may be applied to a prior art camshaft phaser actuated by pressurized engine oil, defining thereby a hybrid oil/brake actuated phaser (not shown).

Note still further that the term "oil" as used herein should be taken to mean any suitable working fluid in chambers 126,128. Synthetic fluids other than petroleum oil, and having a lesser temperature/viscosity dependence, may be preferred in some applications.

Note yet further that a spring (not shown) may be added to the proposed cam phaser to augment the camshaft friction torque 154, and to provide a motive force to drive camshaft rotor 120 to a default position when the engine is off, or in the event of a phaser malfunction. A torsional spring is preferred.

Note also that the proposed phaser assembly may optionally include a locking pin subassembly or any other mechanism for rotationally immobilizing camshaft rotor 120 with respect to stator 112 at a specific predetermined relative angle, for example, full retard of the valve timing, in a way similar to locking pin 30 in prior art phaser 10.

Figure 6:
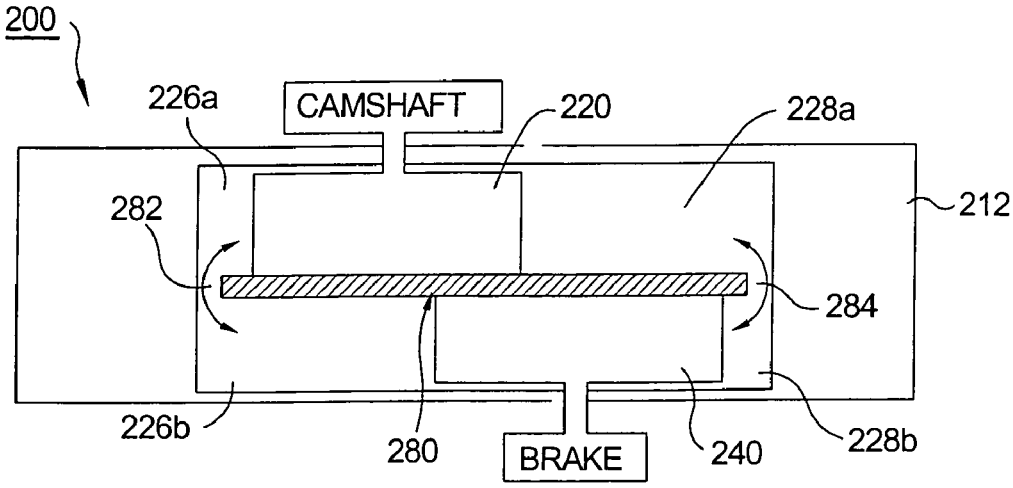
FIG. 6 is a schematic cross-sectional view of a second embodiment of a camshaft phaser improved in accordance with the present invention.

Referring to FIG. 6, in a second embodiment of a camshaft phaser 200 improved in accordance with the invention, a septum plate 280 is installed between camshaft rotor 220 and brake rotor 240. In this embodiment, both the advance chamber and the retard chamber are thus composed of respective sub-chambers 226*a*,226*b* and 228*a*,228*b*, the subchambers being connected by openings 282, 284, respectively, in plate 280. Septum plate 280 can facilitate an optimized configuration of camshaft rotor 220 and brake rotor 240 to avoid leakage and friction between the two rotors as they move relative to one another in operation of the phaser. Further, openings 282,284 may be fitted with check valve(s) and other apparatus (not shown) to further control the flow of oil between respective sub-chambers 226*a*,226*b* and 228*a*,228*b*.

Referring now to FIG. 7, an exemplary brake 150 is shown for actuating a brake rotor 140 in a camshaft phaser 100 improved in accordance with the invention. Various brake mechanisms are envisioned within the scope of the invention, for example, mechanical friction brakes actuated with an electromagnetic actuator (neither is shown) or a known electromagnetic eddy current brake 160.

A presently preferred type of brake is an electromagnetic hysteresis brake 162, such as is available from Magtrol, Inc., West Seneca, N.Y. These types of brakes are commonly used as loads in dynamometers and have three advantages: they are contact-less, producing torque through a magnetic air gap without the use of magnetic particles or friction components, and hence little wear is to be expected; they are easy to control, since the amount of torque is a direct, monotonous function of current, which is generally linear until magnetic saturation; and the torque they produce is generally independent of rotational speed.

The hysteresis effect in magnetism is applied to torque control by the use of two basic components: a reticulated pole structure 164 and a specialty steel rotor/shaft assembly 166 fastened together but not in physical contact with pole structure 164. Pole structure 164 may be formed of any soft magnetic steel, either laminated or not laminated. Until a field coil 168 is energized, a drag cup 170 mounted on shaft assembly 166 can spin freely with the shaft assembly with only minimal friction from the associated bearings. Drag cup 170 is preferably formed of a semi-hard alloy, for example, Alnico, cobalt alloys 26 or 17, Fe—Cr—Co alloys, Fe—Mn alloys, or the like. When a magnetizing force from field coil 168 is applied to drag cup 170, the air gap 172 in pole structure 164 becomes a flux field. Drag cup 170, and hence brake rotor 140, is magnetically restrained from rotation. As would be obvious to one of ordinary skill in the art, the rotational position of camshaft 152 and camshaft rotor 120 may be monitored and appropriate current supplied to field coil 168 to cause a desired level of braking of brake rotor 140 to position camshaft rotor 120 at any desired position within its range of authority between full advance and full retard.

Although a brake is preferred to move phaser rotor 140, because of low electric energy draw, one skilled in the art will recognize that other actuation mechanisms, including electric motors, could be considered as well.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A camshaft phaser for selectively varying the valve timing of an internal combustion engine by varying the phase relationship between an engine crankshaft and an engine camshaft, comprising:

a) a stator drivable by said engine crankshaft and having a plurality of angularly spaced-apart radial lobes extending inwardly;

b) a first rotor disposed within said stator, attachable to said camshaft, and having a plurality of angularly spaced-apart first radial vanes extending outwardly of a first hub interspersed with said spaced-apart radial lobes;

c) a second rotor disposed within said stator adjacent said first rotor having a plurality of angularly spaced-apart second radial vanes extending outwardly of a second hub interspersed with said spaced-apart radial lobes, wherein said interspersion of said first radial vanes and said second radial vanes with said spaced-apart lobes defines a plurality of phase advance chambers and a plurality of phase retard chambers; and d) a working fluid disposed in said phase advance chambers and phase retard chambers;

wherein rotation of said second rotor with respect to said stator in a first direction causes rotation of said first rotor with respect to said stator in a second and opposite direction.

2. A camshaft phaser in accordance with claim 1 wherein a brake is attached to said second rotor for restraining rotation of said second rotor.

3. A camshaft phaser in accordance with claim 2 wherein said brake is selected from the group consisting of friction brake, eddy current brake, and magnetic hysteresis brake.

4. A camshaft phaser in accordance with claim 1 further comprising:

a) a sprocket wheel attached to said stator for mechanically connecting said stator to said engine crankshaft; and b) a phaser cover plate for closing said advance and retard chambers.

5. A camshaft phaser in accordance with claim 1 wherein each of said phase advance chambers and each of said phase retard chambers is of constant volume.

6. A camshaft phaser system in accordance with claim 1 further comprising a perforated septum plate disposed within said stator between said first and second rotors.

7. An internal combustion engine comprising:

a camshaft phaser for selectively varying the valve timing of the engine by varying the phase relationship between an engine crankshaft and an engine camshaft, said phaser including, a stator drivable by said engine crankshaft and having a plurality of angularly spaced-apart radial lobes extending inwardly, a first rotor disposed within said stator, attachable to said camshaft, and having a plurality of angularly spaced-apart first radial vanes extending outwardly of a first hub interspersed with said spaced-apart radial lobes, a second rotor disposed within said stator adjacent said first rotor and having a plurality of angularly spaced-apart second radial vanes extending outwardly of a second hub interspersed with said spaced-apart radial lobes, wherein said interspersion of said first radial vanes and said second radial vanes with said spaced-apart lobes defines a plurality of phase advance chambers and a plurality of phase retard chambers, and a working fluid disposed in said phase advance chambers and phase retard chambers, wherein rotation of said second rotor with respect to said stator in a first direction causes rotation of said first rotor with respect to said stator in a second and opposite direction.

* * * * *